US006561183B1

(12) United States Patent
Spilde et al.

(10) Patent No.: US 6,561,183 B1
(45) **Date of Patent: *May 13, 2003**

(54) FLUID HEATER SYSTEM WITH TILTABLE HEATER ASSEMBLY

(75) Inventors: Gary Spilde, Beresford, SD (US); Andrew Johnke, Beresford, SD (US)

(73) Assignee: Sioux Steam Cleaner Corporation, Beresford, SD (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/702,412

(22) Filed: Oct. 31, 2000

(51) Int. Cl.[7] ..... A47J 27/06; F24H 1/18

(52) U.S. Cl. ..... 126/378.1; 126/349; 122/18.2; 122/250 R

(58) Field of Search ..... 126/344, 349, 126/377.1, 378.1, 376.1, 343.5 R; 431/154, 343; 122/18.2, 13.01, 250 R, 249, 247, 243; 222/164

(56) References Cited

U.S. PATENT DOCUMENTS

| | | | | | |
|---|---|---|---|---|---|
| 219,311 | A | | 9/1879 | Salisbury | 122/244 |
| 430,856 | A | | 6/1890 | Jennings | 122/252 |
| 826,546 | A | | 7/1906 | Cushing | 122/249 |
| 978,491 | A | | 12/1910 | Savage | 126/349 |
| 1,050,632 | A | | 1/1913 | Erk | 122/249 |
| 1,603,649 | A | * | 10/1926 | Tingley | 126/378.1 |
| 2,270,863 | A | * | 1/1942 | Barnes | 122/250 R |
| 2,291,023 | A | | 7/1942 | Burklin | 122/18.4 |
| 2,708,436 | A | | 5/1955 | Foster | 126/349 |
| 3,563,212 | A | | 2/1971 | Hoagland | 122/250 R |
| 4,090,490 | A | | 5/1978 | Riley et al. | 126/25 R |
| 4,180,050 | A | | 12/1979 | Sizemore | 126/25 R |
| 4,352,454 | A | | 10/1982 | Ewing | 126/101 |
| 4,428,363 | A | | 1/1984 | Komula | 126/585 |
| 4,467,783 | A | * | 8/1984 | Hurley et al. | 126/349 |
| 4,479,484 | A | | 10/1984 | Davis | 122/18.2 |
| 4,480,631 | A | | 11/1984 | Kristensen | 122/183 |
| 4,556,104 | A | | 12/1985 | Engelhardt | 122/160 |
| D287,999 | S | | 1/1987 | Stowell | |
| 4,644,906 | A | | 2/1987 | Garabedian et al. | 122/32 |

(List continued on next page.)

FOREIGN PATENT DOCUMENTS

DE 23 30 934 A * 1/1975

*Primary Examiner*—Henry Bennett
*Assistant Examiner*—Josiah Cocks
(74) *Attorney, Agent, or Firm*—Kaardal & Leonard, LLP

(57) ABSTRACT

A fluid heater system with tiltable heater assembly for facilitating the performance of maintenance on the heater assembly. The fluid heater system with tiltable heater assembly includes a support frame and a heater assembly mounted on the support frame. The heater assembly comprises a combustion chamber and a burner apparatus for burning fuel in the combustion chamber. The heater assembly is pivotally mounted on the support frame for permitting pivoting of the heater assembly in a substantially vertical plane with respect to the support frame such that the heater assembly is pivotable between an operational position and a maintenance position. The operational position is characterized by a central axis of the combustion chamber being oriented in a substantially vertical direction and the maintenance position is characterized by the central axis being rotated from the substantially vertical direction toward a generally horizontal direction. A locking structure may be provided for selectively locking the heater assembly with respect to the support frame in the operational position and in the maintenance position. The combustion chamber has a chamber perimeter wall defining a chamber interior, and the chamber perimeter wall has an outer surface. A heating conduit for carrying fluid for heating by the combustion chamber is provided, and the heating conduit has an inlet and an outlet. The heating conduit has a preheating portion adjacent to the inlet, and the preheating portion extends about the outer surface of the chamber perimeter wall of the combustion chamber for absorbing heat from the chamber perimeter wall of the combustion chamber.

26 Claims, 6 Drawing Sheets

U.S. PATENT DOCUMENTS 5,152,253 A 10/1992 Jenko et al. ..... 122/510
5,201,807 A 4/1993 Liljenberg et al. ..... 122/18.4
5,228,413 A 7/1993 Tam ..... 122/250 R
5,540,215 A 7/1996 Fritzsche et al. ..... 126/374.1
5,659,657 A 8/1997 Overdorf
5,816,199 A 10/1998 Khizh et al. ..... 122/18.4
6,435,174 B1 * 8/2002 Spilde et al. ..... 126/378.1

* cited by examiner

FLUID HEATER SYSTEM WITH TILTABLE HEATER ASSEMBLY

BACKGROUND OF THE INVENTION

1. Field of the Invention

The present invention relates to fluid heaters and more particularly pertains to a new fluid heater system with a heater assembly that is tiltable for facilitating the performance of maintenance on the heater assembly and has relatively cooler exterior surfaces for safer operation.

2. Description of the Prior Art

Devices for pressurizing and heating fluid are known in the art. One type of fluid heating device uses combustion of a fuel in a combustion chamber to heat fluid moving through a length of tubing located in the combustion chamber. Typically, a burner is located at one end of the combustion chamber, and one or more coils of the tubing are typically located in the chamber toward the other end of the chamber. The burner directs a flame toward and over the coils of tubing. Some types of fluid heaters position the burner below the combustion chamber, and the burner fires upward toward a coil positioned above the burner. This arrangement is highly preferable for a variety of operational reasons but places a significant maintenance hardship on user of the devices.

Significantly, positioning of the burner on the bottom of the chamber places the burner beneath the combustion chamber in a difficult orientation for performing periodic maintenance on the burner. Support framing for the combustion chamber typically extends below the burner and thus further restricts access to the burner. In order to avoid having to crawl under the fluid heating device for servicing the burner, one approach has been to periodically invert the entire fluid heating device during the servicing. Because of the presence of fuels, cleaning solutions, and engine lubricating fluids often held in tanks on the fluid heating device, tipping of the device is disfavored because the possibility of spilling the liquids requires that all of the fluids be removed prior to each servicing, and often requires awkward propping of the device in the inverted position. As these devices typically weigh between 350 and 800 pounds, any attempt to tip them is both difficult and dangerous.

Another approach for facilitating servicing of the burner has been to permanently orient the combustion chamber of the device with the burner and the coil of tubing at substantially the same vertical level, so that the burner directs the flame in a generally horizontal direction toward the coils. Since the burner is essentially located beside of the combustion chamber, the burner is generally more accessible for periodic maintenance. However, with the tubing coiled about a horizontal axis, the tubing is difficult, if not impossible, to completely drain of fluid when necessary, such as for preparing the fluid heater device for maintenance on the coil of tubing or exposure to freezing temperatures, or to prevent corrosion during a period of extended non-use.

A further challenge presented by conventional fluid heaters employing a combustion chamber is the danger of burning or injuring the personnel working closely to the surfaces of the heater assembly, especially those exterior housing surfaces shrouding the combustion chamber in which the fuel is burned. Typically, insulation is positioned inside of the exterior housing surfaces in an attempt to resist heat transfer to the housing surfaces for keeping the exterior surfaces cooler than the hot surfaces of the combustion chamber. However, the use of insulation often fails to keep the housing surfaces cool enough to be safe to touch without injuring the skin of the operating personnel. Furthermore, simply adding enough additional layers of insulation to be effective produces a device that is excessively bulky, and the heat dissipated through the insulation is wasted.

These problems presented by conventional fluid heater designs have significantly impaired the safe use and regular maintenance of known fluid heaters.

SUMMARY OF THE INVENTION

In view of the foregoing disadvantages inherent in the known types of fluid heaters now present in the prior art, the present invention provides a new fluid heater system with a heater assembly design that facilitates the performance of maintenance on the heater assembly and permits safer operation of the heater assembly.

To attain this purpose, the present invention generally comprises a support frame and a heater assembly mounted on the support frame. The heater assembly comprises a combustion chamber and a burner apparatus for burning fuel in the combustion chamber. The heater assembly is pivotally mounted on the support frame for permitting pivoting of the heater assembly in a substantially vertical plane with respect to the support frame such that the heater assembly is pivotable between an operational position and a maintenance position. The operational position is characterized by a central axis of the combustion chamber being oriented in a substantially vertical direction and the maintenance position is characterized by the central axis being rotated from the substantially vertical direction toward a generally horizontal direction. A locking structure may be provided for selectively locking the heater assembly with respect to the support frame in the operational position and in the maintenance position. The combustion chamber has a chamber perimeter wall defining a chamber interior, and the chamber perimeter wall has an outer surface. A heating conduit for carrying fluid for heating by the combustion chamber is provided, and the heating conduit has an inlet and an outlet. The heating conduit has a preheating portion adjacent to the inlet, and the preheating portion extends about the outer surface of the chamber perimeter wall of the combustion chamber for absorbing heat from the chamber perimeter wall of the combustion chamber.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
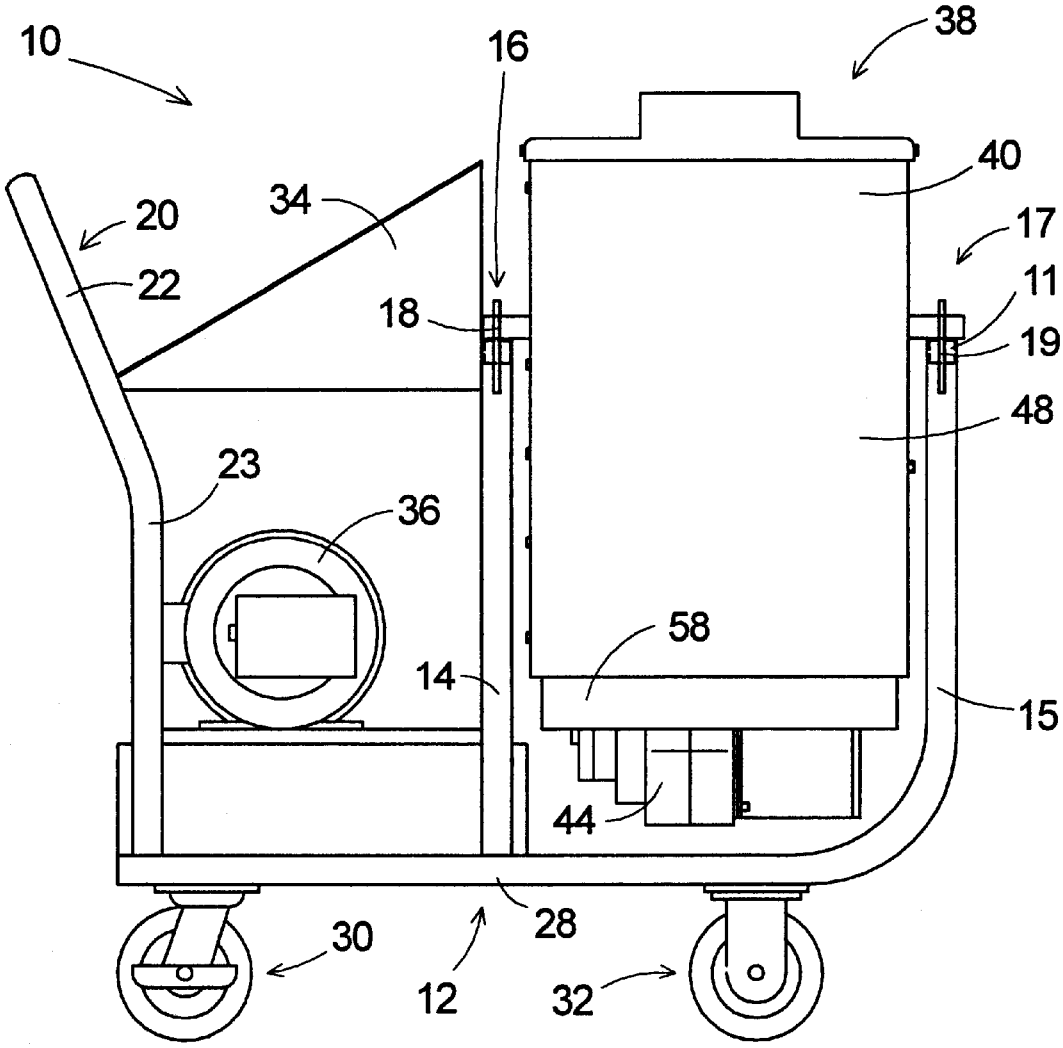
FIG. 1 is a schematic side view of a new fluid heater system with the improved heater assembly according to the present invention.
Figure 2:
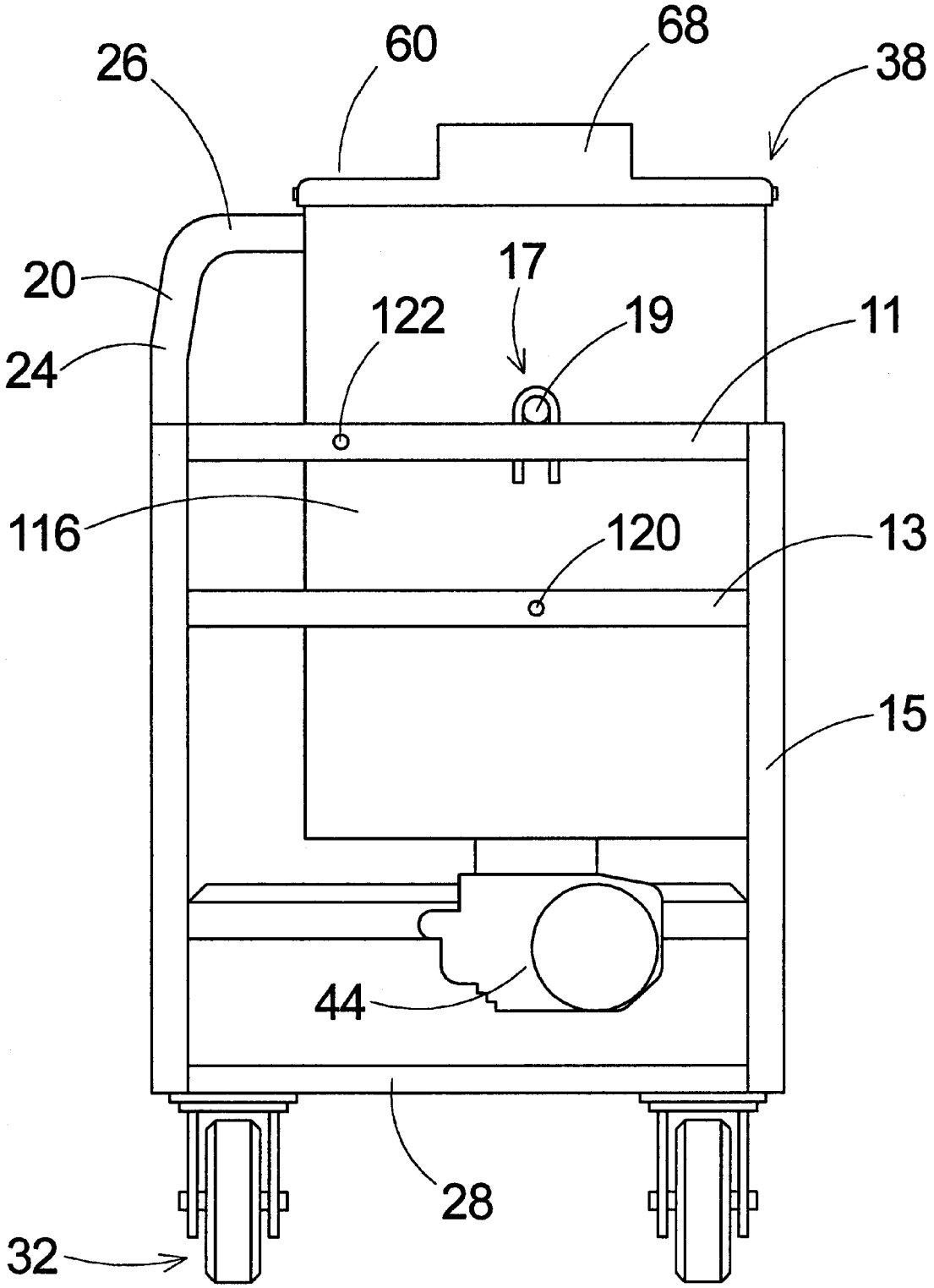
FIG. 2 is a schematic end view of the present invention particularly illustrating the heater assembly in the operational position.
Figure 3:
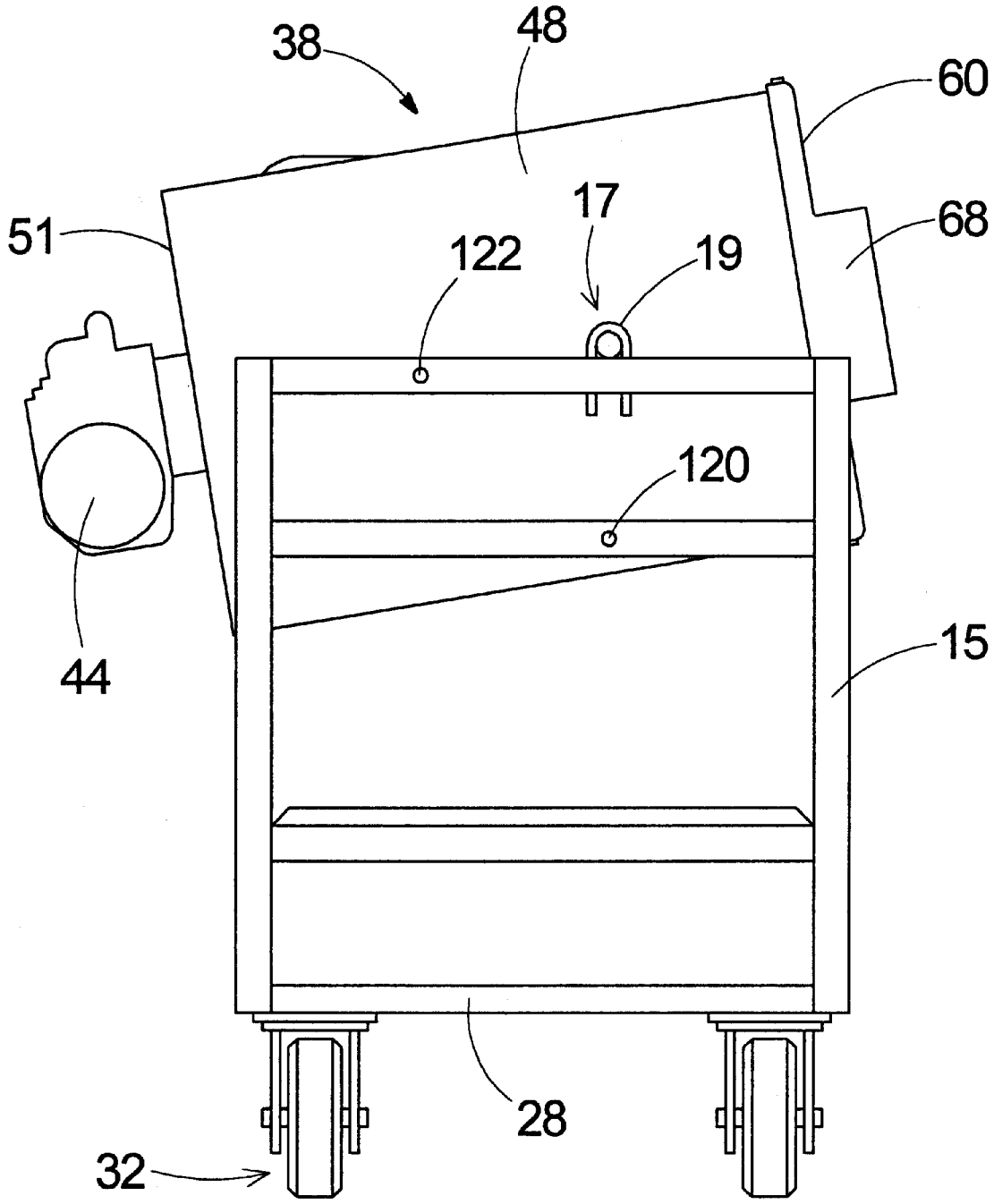
FIG. 3 is a schematic end view of the present invention particularly illustrating the heater assembly in the maintenance position.
Figure 4:
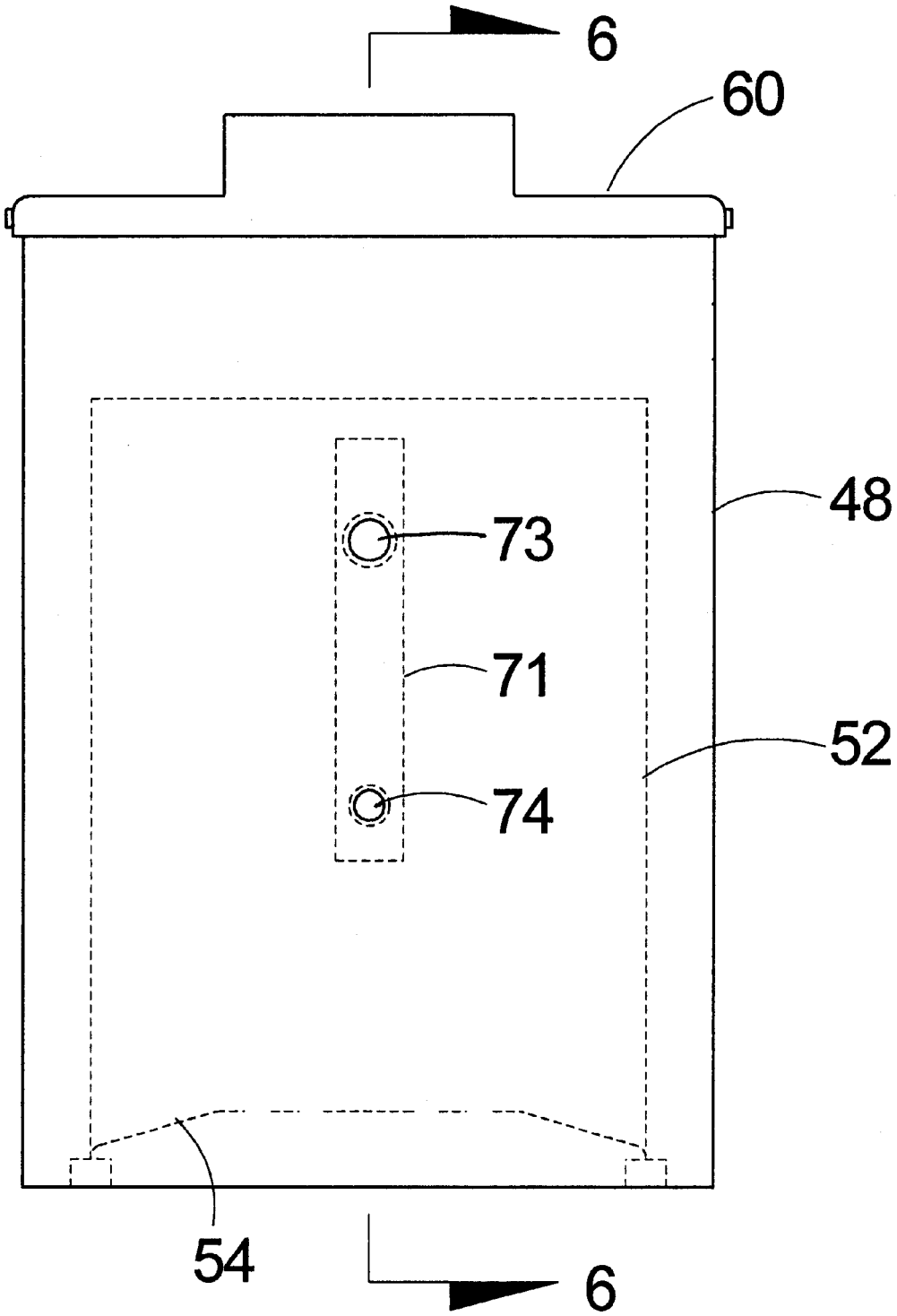
FIG. 4 is a schematic side view of the heater assembly of the present invention.
Figure 5:
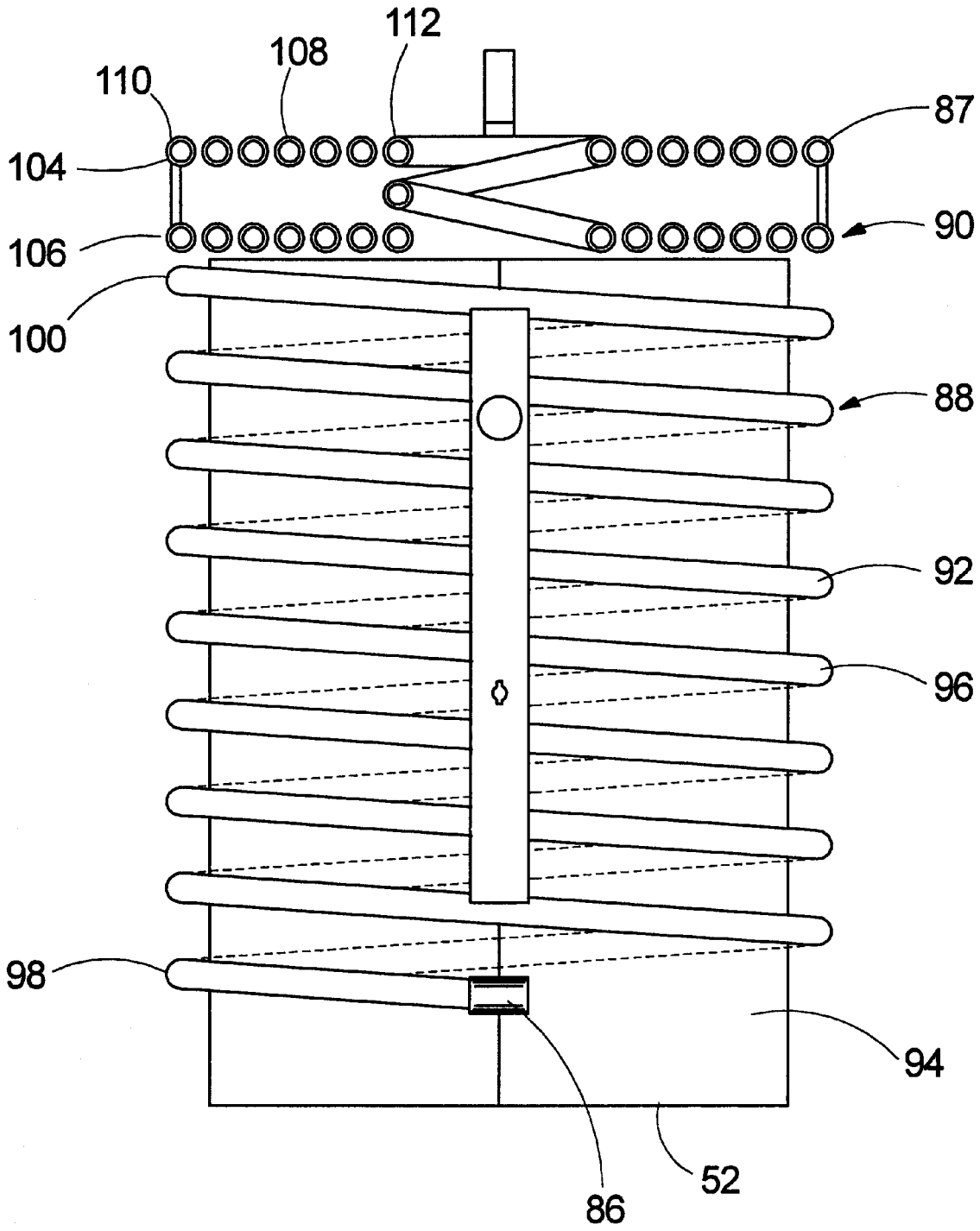
FIG. 5 is a schematic end view of the combustion chamber and heating conduit of the present invention.
Figure 6:
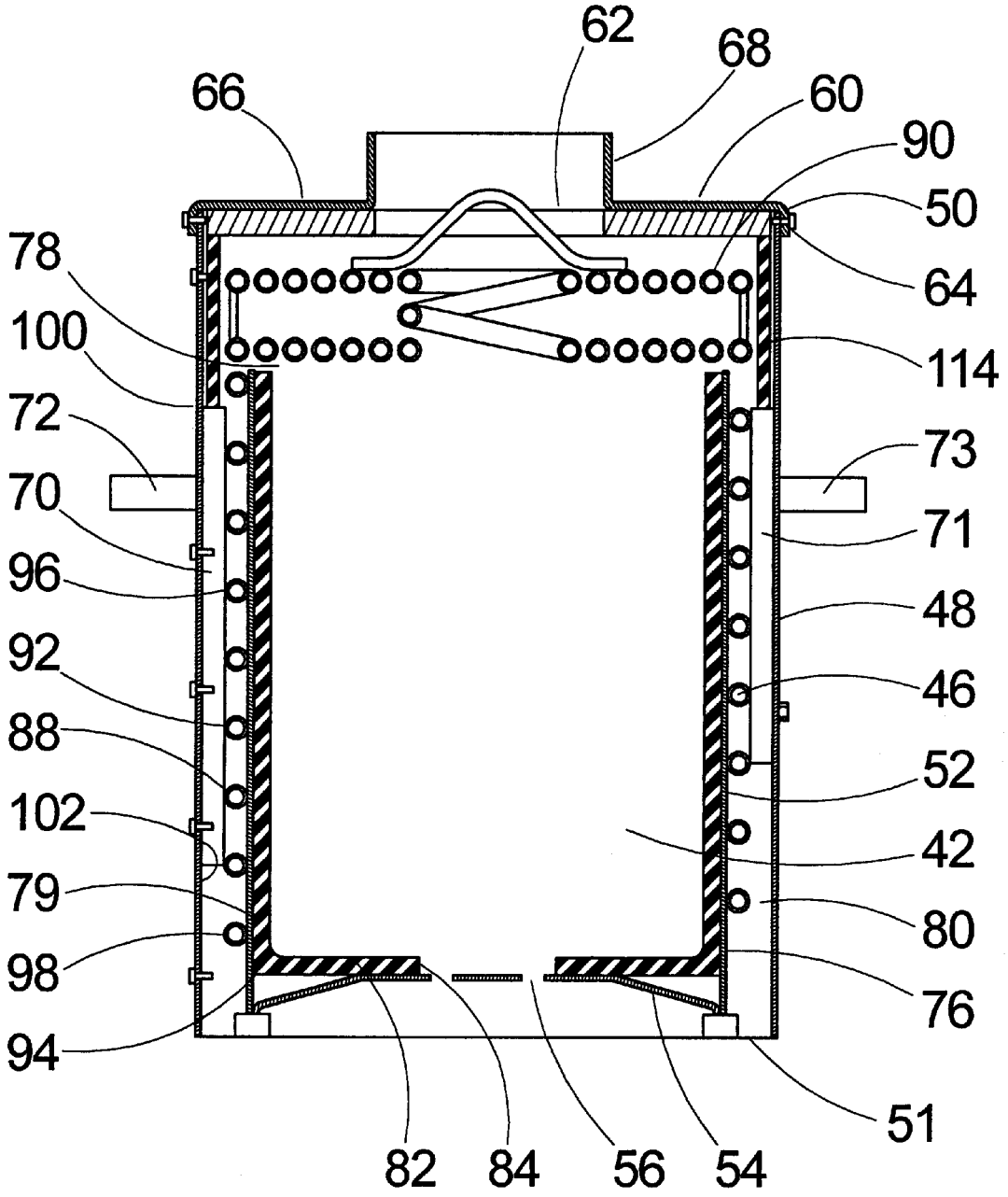
FIG. 6 is a schematic sectional view of the heater assembly of the present invention taken along line 6—6 of FIG. 4.

With reference now to the drawings, and in particular to FIGS. 1 through 6 thereof, a new fluid heater system with improved heater assembly embodying the principles and concepts of the present invention and generally designated by the reference numeral 10 will be described:

As best illustrated in FIGS. 1 through 6, the fluid heating apparatus of the invention generally comprises a support frame 12, and a heater assembly 38 including a heater housing 40, a combustion chamber 42, a burner apparatus 44, and a heating conduit 46 for capturing (in a flow of fluid) heat from the combustion chamber.

The support frame 12 of the invention preferably includes a pair of upstanding heater support members 14, 15 that are generally spaced from each other. Each of the heater support members 14, 15 may comprise a pair of substantially vertically oriented support posts and a cross member 11 extending between the support posts. One of the heater support members may have a second cross member 13 for a purpose to be described below. Each of the upstanding heater support members 14, 15 preferably has a pivot mount 16, 17 formed thereon. One of the pivot mounts is preferably formed on the cross member 11 of each of the heater support members. Illustratively, each of the pivot mounts 16, 17 may comprise a U-shaped bolt 18, 19 having arms extending through the cross member 11. Optionally, the structure of the pivot mount may take other forms, such as, for example, a hole or channel formed in the cross member. Preferably, the pivot mount 16 of a first one 14 of the heater support members is axially aligned with the pivot mount 17 of a second one 15 of the heater support members.

The support frame 12 may include an upstanding handle member 20. The upstanding handle member preferably includes an upper portion 22 and a lower portion 23. The upper portion 22 may lie in a plane angled from a plane in which the lower portion 23 lies in order to extend the upper portion away from the bulk of the support frame for facilitating gripping by user walking behind the frame when the frame is being pushed. The angle between the planes of the upper 22 and lower 23 portions is preferably an obtuse angle, with the obtuse angle illustratively measuring approximately 160 degrees. Ideally, the lower portion 23 is substantially vertically oriented, and is oriented substantially parallel to the first 14 and second 15 heater support members. The handle member may comprise a pair of upstanding handle posts 24 and a handle cross member 26 extending between the handle posts.

The support frame 12 also includes a base member 28. The heater support members 14, 15,and the handle member 20 have lower portions that are mounted on the base member 28, and the support 14, 15 and handle 20 members extend upwardly from the base member.

The support frame 12 may also include a plurality of wheels for permitting rolling transport of the support frame across a surface. The plurality of wheels is mounted on the base member 28. Preferably, a first pair 30 of the plurality of wheels is mounted on the base member in a manner permitting rotation of the wheels in a single plane, and illustratively the first pair 30 is mounted adjacent one of the support members 14, 15. Preferably, a second pair 32 of the plurality of wheels is mounted on the base member in a manner permitting rotation of the wheels in a plurality of planes, such as, for example, a swivel caster structure. The second pair 32 of wheels may be mounted on the base member adjacent the handle member 20. Optionally, at least one of the second pair 32 of wheels has a locking means for selectively locking each wheel against rotation, and the locking means may be actuated by a rocker lever mounted on the axle of the wheel.

A control panel 34 may be provided on the support frame 12 for supporting controls for the fluid heater apparatus. Illustratively, the control panel 34 may be mounted on the handle member 20 and the first heater support member 14.

A pump 36 may optionally be provided for moving the fluid to be heated through the fluid heater apparatus, and the pump is mounted on the support frame 12.

The heater assembly 38 of the invention is provided for heating fluid, such as water, that is moved through the heater assembly by means such as, for example, the pump 36. The heater assembly 38 is mounted on the support frame 12 in a manner supporting the heater assembly above a ground surface, and preferably above the base member of the frame 12.

The heater assembly generally comprises the heater housing 40, the combustion chamber 42 located in the heater housing, the burner apparatus 44 mounted on the heater housing, and the heating conduit 46 for moving fluid through the heater housing.

The heater housing 40 includes an outer peripheral wall 48. The outer peripheral wall defines an interior of the heater housing, and the outer peripheral wall has an upper opening 50 and a lower opening 51 into the interior. The preferred outer peripheral wall has a substantially cylindrical shape, with the upper 50 and lower 51 openings being substantially circular.

The heater housing 40 may also include an inner peripheral wall 52. The inner peripheral wall 52 is positioned in the interior defined by the outer peripheral wall 48. The inner peripheral wall may have a substantially cylindrical shape, and preferably, the cylindrical inner peripheral wall is oriented coaxially with the cylindrical outer peripheral wall.

The heater housing 40 may also include a bottom wall 54 that extends across the lower opening of the outer peripheral wall. The bottom wall may have a central burner opening 56 for accommodating the burner assembly. In one embodiment of the invention, the bottom wall has a shallow frustaconical shape that has a generally concave outward surface.

The heater housing 40 may also include a skirt 58 that extends from the outer peripheral wall at the lower opening for at least partially protecting the burner assembly from, for example, spray from a pressurized spray gun. Preferably, the skirt has a substantially cylindrical shape and extends from the outer peripheral wall in a downward direction from the lower opening. The skirt may comprise a resiliently flexible material that facilitates manual movement of the skirt for access to the burner assembly mounted on the bottom wall area of the heater housing.

The heater housing 40 may also include a top wall 60 covering the upper opening 50 of the outer peripheral wall. The top wall may be removably mounted on the outer peripheral wall adjacent to the upper opening. The top wall may have a circular shape for mounting on a cylindrically-shaped outer peripheral wall. Preferably, the top wall has a central vent opening 62 for permitting exhaust of combustion gases from the combustion chamber. The top wall thus has an annular shape. In one illustrative embodiment of the invention, the top wall has a diameter more than twice a diameter of the central vent opening. A retaining lip 64 may depend from an outer edge of the top wall, and may be removably secured to the outer peripheral wall. Optionally, an insulative material 66 may be positioned adjacent to an inward surface of the top wall for reducing the temperature of the top wall of the heater housing.

Optionally, a vent wall 68 may be provided surrounding the central vent opening in the top wall. The vent wall extends generally upwardly in a substantially perpendicular orientation to the top wall.

A pair of mounting members 70, 71 are provided for supporting the heater housing on the heater support members 14, 15 of the support frame 12. Each of the mounting members may be located adjacent an inner surface of the outer peripheral wall 48. The mounting members 70, 71 are located adjacent to substantially diametrically opposite locations of the outer peripheral wall. In one embodiment of the invention having the inner peripheral wall 52, the mounting members are positioned between the outer and inner peripheral walls.

A pair of pivot shafts 72, 73 are provided for mounting the heater housing to the support frame. Each of the pivot shafts extend outwardly from the outer peripheral wall, and each of the pivot shafts are rotatably received in one of the pivot mounts 16, 17 of the heater support members of the support frame. A first one 72 of the pivot shafts is axially aligned with and is substantially coaxial with a second one 73 of the pivot shafts. The first one 72 of the pivot shafts extends in a diametrically opposite direction from the heater housing with respect to the second one 73 of the pivot shafts. Each of the pivot shafts is pivotally mounted on one of the mounting members. In the embodiment of the invention having pivot mounts employing U-shaped bolts 18, 19, the U-shaped bolt 19 clamps a portion of one 17 of the pivot shafts against the cross member 11. Preferably, one 71 of the mounting members has a first locking aperture 74 formed in the mounting member at a location that is separated from the location of the pivot shaft mounted on the mounting member.

The combustion chamber 42 of the heater assembly includes a chamber perimeter wall 76 that defines a chamber interior. The chamber perimeter wall has an upper end 78 and a lower end 79, and the upper end of the chamber perimeter wall is preferably substantially open into the chamber interior. The chamber perimeter wall of the combustion chamber may be substantially cylindrical, and is preferably substantially coaxial with the outer peripheral wall of the heater housing such that a perimeter chamber 80 is formed between the chamber perimeter wall of the combustion chamber and the outer peripheral wall of the heater housing. In the embodiment of the invention employing an inner peripheral wall 52, the chamber perimeter wall has an outer surface oriented adjacent to an inner surface of the inner peripheral wall. Preferably, the chamber perimeter wall 76 comprises a material that reflects the heat from combustion back into the interior of the combustion chamber. Ideally, the material of the chamber perimeter wall comprises a refractive material for reflecting much of the combustion heat, and retaining a significant portion of the heat that is not reflected.

A heat reflective chamber floor wall 82 may be provided that extends across the chamber interior adjacent to the lower end of the chamber perimeter wall. The chamber floor wall may have a central opening 84 therein for receiving a portion of the burner assembly. The chamber floor wall preferably comprises a heat reflective material similar to the material forming the chamber perimeter wall, such as a refractive material.

The burner apparatus 44 is provided for burning fuel in the interior of the combustion chamber. The burner apparatus expels heat into the chamber interior of the combustion chamber. The burner apparatus is mounted on the bottom wall 54 of the heater housing and directs heat upwardly into the chamber interior of the combustion chamber toward the upper end of the perimeter wall. The burner apparatus may extend through the central opening 84 in the chamber floor wall 82 of the combustion chamber, with a serviceable portion of the burner apparatus being located below the floor wall.

The heating conduit 46 for moving fluid through the heater housing has an inlet 86 and an outlet 87. Preferably, the inlet 86 is fluidly connected to the pump 36 and the outlet 87 is fluidly connected, for example, to a dispensing hose (not shown) and a spray gun (not shown). The heating conduit has a preheating portion 88 that is located adjacent in the fluid flow to the inlet of the heating conduit, and a heating portion 90 that is located adjacent in the fluid flow to the outlet of the heating conduit.

Significantly, the preheating portion 88 of the heating conduit extends about the chamber perimeter wall 76 in the perimeter chamber 80 for absorbing heat passing through the chamber perimeter wall. The movement of unheated, relatively cool fluid (from, for example, the pump) through the perimeter chamber 80 of the heater housing permits the fluid to be initially heated prior to entry of the heating conduit into the combustion chamber. More importantly, the preheating portion serves a portion of the heat passing through the chamber perimeter wall 76 from the combustion chamber which would otherwise pass through the perimeter chamber and heat the outer peripheral wall of the housing and create a burning injury hazard to exposed skin touching the outer surface of the outer peripheral wall.

The preheating portion 88 of the heating conduit comprises a substantially helical coil 92 extending around the chamber perimeter wall. If an inner peripheral wall is included in the heater housing, the preheating portion of the heating conduit may contact an outer surface 94 of the inner peripheral wall for maximizing the heat transfer from the chamber perimeter wall and the inner peripheral wall to the preheating portion of the heating conduit.

The helical coil 92 comprises a plurality of loops 96, and preferably, all of the loops have substantially equal diameter. The helical coil generally extends from a location adjacent to the lower end 79 of the chamber perimeter wall to a location adjacent to the upper end 78 of the chamber perimeter wall. Preferably, each of the loops 96 may be spaced from an adjacent one of the loops, and optionally the spacing between centers of adjacent loops is substantially uniform. Illustratively, the spacing between adjacent loops may be approximately two inches. Optionally, the spacing between adjacent loops may be reduced (or even eliminated) toward the upper region of the heater housing, especially at a vertical level above the upper end of the chamber perimeter wall.

In one embodiment of the invention, the helical coil 92 of the preheating portion of the heating conduit may include approximately eight loops. Preferably, each of the mounting members 70, 71 is mounted on at least two of the loops of the helical coil of the preheating portion for supporting the heating assembly. The pivot shafts 72, 73 extend outwardly through the outer peripheral wall 48 and engage the pivot mounts 16, 17.

The helical coil 92 has a lowermost loop 98 and an uppermost loop 100. The preheating portion is adapted such that fluid enters the lowermost loop 98 of the helical coil and exits the uppermost coil 100 of the helical coil. Optionally, the helical coil 92 is spaced from an inner surface 102 of the outer peripheral wall of the heater housing to produce an air space between the helical coil and the outer peripheral wall for reducing any heat transfer between the preheating portion 88 and the outer peripheral wall 48. Illustratively, the space between an outermost surface of the helical coil and the inner surface of the outer peripheral wall may be approximately one inch.

The heating portion 90 of the heating conduit is positioned adjacent to the upper end 78 of the chamber perimeter wall of the combustion chamber in a location permitting heat rising in the chamber interior to pass over the heating portion of the heating conduit before being vented from the interior of the heater housing.

In the preferred heater assembly, the preheating portion 88 is located below the heating portion 90. In one illustrative embodiment, a length of the preheating portion of the heating conduit is substantially equal to a length of the heating portion of the heating conduit, although the length of the heating portion is preferably at least as long, and may be relatively longer, than the preheating portion.

Significantly, the heating portion 90 comprises at least one tier, and most preferably includes an upper tier 104 oriented above a lower tier 106. Each tier 104, 106 comprises a spiral coil comprising a plurality of spirals 108. Any number of tiers may be welded together to increase the heat-transfer surface area as needed to reach the desired fluid temperature. The spirals 108 of each tier lie substantially in a common or single plane. The plane of each tier is preferably substantially horizontally oriented. Each tier of the heating portion has an outermost spiral 110 and an innermost spiral 112, with spirals nested therebetween. The outermost spiral 110 of the spiral coil of the heating portion is fluidly connected to the uppermost loop 100 of the helical coil of the preheating portion 88. The outermost loop of the heating portion preferably has a diameter approximately equal to the loops of the preheating portion. Illustratively, each of the tiers 104, 106 includes approximately seven spirals.

The innermost spiral of the lower tier is fluidly connected to the innermost spiral of the upper tier. The upper and lower tiers are preferably oriented substantially parallel to each other. Illustratively, the distance between adjacent spirals of the upper and lower tiers is approximately 2 inches. The tiers may be adapted such that fluid is moved from the outermost spiral of the lower tier to the innermost spiral of the lower tier to the innermost spiral of the upper tier to the outermost spiral of the upper tier.

Optionally, an insulative annular wall 114 may be positioned laterally outward from the heating portion 90 of the heating conduit for holding heat in the area of the combustion chamber. The insulative annular wall 114 is positioned inside of the outer peripheral wall 48 of the heater housing.

Significantly, the heater assembly 38 is pivotally mounted on the support frame 12 in a manner that permits selective pivoting of the heater assembly with respect to the support frame. An operational position (see FIG. 2) of the heater assembly is characterized by a central axis of the combustion chamber being oriented in a substantially vertical direction. A maintenance position, (see FIG. 3) of the heater assembly is characterized by the central axis being shifted or rotated from the substantially vertical direction toward a generally horizontal direction. Thus, pivoting of the heater assembly from the operational position to the maintenance position raises the burner assembly relative to the combustion chamber. The maintenance position permits the burner assembly 44 mounted at the base of the combustion chamber to be worked upon without having to reach under the heater assembly, especially when the burner assembly is located in close proximity to the base member of the support frame at a height of only about 12 inches from the ground surface.

A locking means or mechanism 116 may be provided for selectively locking the heater assembly 38 with respect to the support frame in the operational position and the maintenance position. The locking mechanism 116 may include the first locking aperture 74 formed on the heater housing at a distance from one 73 of the pivot shafts of the heater housing and extending through the outer peripheral wall. A second locking aperture 120 is provided for securing the heater assembly in the operational position. The second locking aperture may be formed on one 15 of the heater support members, such as on an upper one 11 of the cross members. The second locking aperture is alignable with the first locking aperture 74 when the heater housing 40 is in the operational position for permitting a fastener to be removably extended through the second locking aperture and into the first locking aperture, which may be threaded for removably holding the fastener in the first and second locking apertures. The second locking aperture 120 is located below the pivot mount 17 in the heater support member 15. A third locking aperture 122 is provided for securing the heater assembly in the maintenance position. The third locking aperture may be formed on the heater support member 15, such as on a lower one 13 of the cross members. The third locking aperture is alignable with the first locking aperture when the heater housing is in the maintenance position for permitting a fastener to be removably extended through the third locking aperture and into the first locking aperture. The third locking aperture 122 is preferably located in a substantially horizontal direction from the pivot mount in the first heater support member.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A fluid heating apparatus comprising:

a support frame;

a heater assembly mounted on the support frame, the heater assembly comprising:

a combustion chamber having a lower end and an upper end;

a burner apparatus for burning fuel in the combustion chamber, the burner apparatus being mounted at the lower end of the combustion chamber; and a heating conduit for carrying a flow of fluid through the heater assembly for heating the fluid by the combustion chamber, the heating conduit having an inlet and an outlet;

wherein the heater assembly is pivotally mounted on the support frame for permitting pivoting of the heater assembly in a substantially vertical plane with respect to the support frame such that the heater assembly is pivotable between an operational position and a maintenance position.

2. The apparatus of claim 1 wherein the operational position is characterized by a central axis of the combustion chamber being oriented in a substantially vertical direction and the maintenance position is characterized by the central axis being rotated from the substantially vertical orientation toward a generally horizontal orientation.

3. The apparatus of claim 1 wherein the heater assembly is adapted such that pivoting of the heater assembly from the operational position to the maintenance position raises a vertical level of the burner assembly relative to the combustion chamber.

4. The apparatus of claim 1 additionally comprising locking means for selectively locking the heater assembly with respect to the support frame in the operational position and in the maintenance position.

5. The apparatus of claim 4 wherein the heater assembly comprises a heater housing and the support frame includes at least one heater support member, wherein at least one pivot shaft pivotally mounts the heater housing to the heater support member, the locking means selectively and positively locking the heater assembly in at least two positions, the locking means comprising a first locking aperture located on the heater housing at a distance from the pivot shaft, a second locking aperture being located on the heater support member and being alignable with the first locking aperture when the heater housing is in the operational position, and a third locking aperture being located on the heater support member and being alignable with the first locking aperture when the heater housing is in the maintenance position.

6. The apparatus of claim 5 wherein the second locking aperture is spaced in a substantially vertical direction from the pivot shaft, and the third locking aperture is spaced in a substantially horizontal direction from the pivot shaft.

7. The apparatus of claim 1 wherein the support frame comprises a pair of spaced upstanding heater support members, each of the upstanding heater support members having a pivot mount formed therein, the pivot mount of a first one of the heater support members being axially aligned with the pivot mount of a second one of the heater support members.

8. The apparatus of claim 7 wherein the heater assembly comprises a heater housing with a pair of pivot shafts each extending outwardly from the heater housing in substantially diametrically opposite directions, each of the pivot shafts being rotatably received in one of the pivot mounts of the heater support members of the support frame.

9. The apparatus of claim 1 additionally comprising a pump in fluid communication with the heating conduit for producing the flow of fluid through the heating conduit for heating the flowing fluid by the combustion chamber.

10. The apparatus of claim 1 wherein the burner apparatus produces a flame for generating heat.

11. The apparatus of claim 1 wherein the heating conduit has a substantially uniform size between the inlet and the outlet thereof.

12. The apparatus of claim 1 wherein the combustion chamber has a chamber perimeter wall, and wherein the heating conduit has a preheating portion adjacent to the inlet, the preheating portion of the heating conduit extending about the outer surface of the chamber perimeter wall of the combustion chamber for absorbing heat from the chamber perimeter wall.

13. The apparatus of claim 12 wherein the preheating portion of the heating conduit comprises a substantially helical coil extending around the chamber perimeter wall, the helical coil comprising a plurality of loops.

14. The apparatus of claim 13 wherein the plurality of loops each have substantially equal diameters.

15. The apparatus of claim 1 wherein the heater assembly additionally comprises a heater housing extending about the combustion chamber, the heater housing including an outer peripheral wall.

16. The apparatus of claim 15 wherein the heater housing includes an inner peripheral wall, the inner peripheral wall being positioned in an interior defined by the outer peripheral wall.

17. The apparatus of claim 16 wherein the outer peripheral wall has a substantially cylindrical shape with an upper opening and a lower opening, the inner peripheral wall having a substantially cylindrical shape, the inner peripheral wall being oriented substantially coaxially with respect to the outer peripheral wall.

18. The apparatus of claim 17 wherein the chamber perimeter wall of the combustion chamber is oriented substantially coaxially with respect to the outer peripheral wall of the heater housing such that a perimeter chamber is formed between the chamber perimeter wall of the combustion chamber and the peripheral wall of the heater housing.

19. The apparatus of claim 1 wherein the combustion chamber includes a chamber perimeter wall comprising a heat reflective material.

20. The apparatus of claim 12 wherein the heater assembly additionally comprises a heater housing extending about the combustion chamber, the heater housing including an outer peripheral wall and an inner peripheral wall, the inner peripheral wall being positioned in an interior defined by the outer peripheral wall, and wherein the preheating portion of the heating conduit is spaced from an inner surface of the outer peripheral wall of the heater housing to produce an air space between the heating conduit and the outer peripheral wall.

21. The apparatus of claim 20 wherein the preheating portion of the heating conduit contacts an outer surface of the inner peripheral wall of the heater housing.

22. The apparatus of claim 1 wherein the heating conduit is drainable by gravity when the heater assembly is in the operational position.

23. The apparatus of claim 19 wherein the heat reflective material of the chamber perimeter wall minimizes heat movement through the chamber perimeter wall to an outer surface of the chamber perimeter wall.

24. A fluid heating apparatus comprising:

a support frame;

a heater assembly mounted on the support frame, the heater assembly comprising:

a combustion chamber having a lower end and an upper end;

a burner apparatus for burning fuel in the combustion chamber, the burner apparatus being mounted at the lower end of the combustion chamber; and wherein the heater assembly is pivotally mounted on the support frame for permitting pivoting of the heater assembly in a substantially vertical plane with respect to the support frame such that the heater assembly is pivotable between an operational position and a maintenance position; and wherein the heater assembly comprises a heater housing and the support frame includes at least one heater support member, wherein at least one pivot shaft pivotally mounts the heater housing to the heater support member, the locking means selectively and positively locking the heater assembly in at least two positions, the locking means comprising a first locking aperture located on the heater housing at a distance from the pivot shaft, a second locking aperture being located on the heater support member and being alignable with the first locking aperture when the heater housing is in the operational position, and a third locking aperture being located on the heater support member and being alignable with the first locking aperture when the heater housing is in the maintenance position.

25. The apparatus of claim 24 wherein the second locking aperture is spaced in a substantially vertical direction from the pivot shaft, and the third locking aperture is spaced in a substantially horizontal direction from the pivot shaft.

26. A fluid heating apparatus comprising:

a support frame;

a heater assembly mounted on the support frame, the heater assembly comprising:

a combustion chamber having a lower end and an upper end;

a burner apparatus for burning fuel in the combustion chamber, the burner apparatus being mounted at the lower end of the combustion chamber; and a heating conduit for carrying a continuous flow of fluid through the heater assembly for heating the fluid by the combustion chamber, the heating conduit having an inlet and an outlet; and a pump in fluid communication with the heating conduit for producing the continuous flow of fluid through the heating conduit for heating the continuously flowing fluid by the combustion chamber;

wherein the heater assembly is pivotally mounted on the support frame for permitting pivoting of the assembly in a substantially vertical plane with respect to the support frame such that the heater assembly is pivotable between an operational position and a maintenance position.

* * * * *